US011499211B2

(12) United States Patent
Roussel et al.

(10) Patent No.: US 11,499,211 B2
(45) Date of Patent: Nov. 15, 2022

(54) NICKEL-BASED REFRACTORY ALLOY WITH HIGH CHROMIUM CONTENT AND ASSOCIATED DESIGN METHOD

(71) Applicant: Manoir Industries, Paris (FR)

(72) Inventors: Manuel Roussel, Rouen (FR); Antoine Facco, Rouen (FR); Mériem Abikchi, Rouen (FR); Mathieu Couvrat, Pitres (FR)

(73) Assignee: Manoir Industries, Paris (FR)

( * ) Notice: Subject to any disclaimer, the term of this patent is extended or adjusted under 35 U.S.C. 154(b) by 131 days.

(21) Appl. No.: 16/915,603

(22) Filed: Jun. 29, 2020

(65) Prior Publication Data

US 2020/0407829 A1 Dec. 31, 2020

(30) Foreign Application Priority Data

Jun. 28, 2019 (FR) ..... 1907175

(51) Int. Cl.

| | |
|---|---|
| ***C22C 30/00*** | (2006.01) |
| ***C22F 1/10*** | (2006.01) |
| ***C22C 19/05*** | (2006.01) |

(52) U.S. Cl.

CPC ..... *C22C 30/00* (2013.01); *C22C 19/052* (2013.01); *C22F 1/10* (2013.01)

(58) Field of Classification Search

CPC ..... C22C 19/052; C22C 30/00; C22F 1/10

See application file for complete search history.

(56) References Cited

FOREIGN PATENT DOCUMENTS

| | | | | |
|---|---|---|---|---|
| CA | 3028948 A1 * | 1/2018 | ..... | B01J 23/26 |
| EP | 0765948 B1 | 4/1997 | | |
| FR | 2333870 A1 | 6/1979 | | |
| FR | 2939808 A1 | 1/2011 | | |

OTHER PUBLICATIONS

French Search Report for French Application No. 1907175 dated Mar. 3, 2020, 2 pages.

French Written Opinion for French Application No. 1907175 dated Mar. 3, 2020, 5 pages.

Roussel et al., Influence of Solidification Induced Composition Gradients on Carbide Precipitation in FeNiCr Heat Resistant Steels, Materialia, vol. 4, (2018), pp. 331-339.

* cited by examiner

*Primary Examiner* — Jessee R Roe

(74) *Attorney, Agent, or Firm* — TraskBritt

(57) ABSTRACT

An austenitic alloy based on nickel and having a high chromium content, intended to be used at a given operating temperature between 900° C. and 1150° C., comprises the following elements by mass percentage: chromium between 40% and 45%; iron between 10% and 14%; carbon between 0.4% and 0.6%; titanium between 0.05% and 0.2%; niobium between 0.5% and 1.5%; at least one reactive element, selected from rare earths or hafnium, between 0.002% and 0.1%; silicon between 0% and 1%; manganese between 0% and 0.5%; nickel to balance the alloy elements. In addition, the alloy has a molar fraction of more than 0.1% of secondary carbo-nitrides rich in niobium and/or titanium, after the operating temperature has been applied thereto. The disclosure also relates to a method for designing such an alloy and to a method for validating such an alloy.

8 Claims, 1 Drawing Sheet

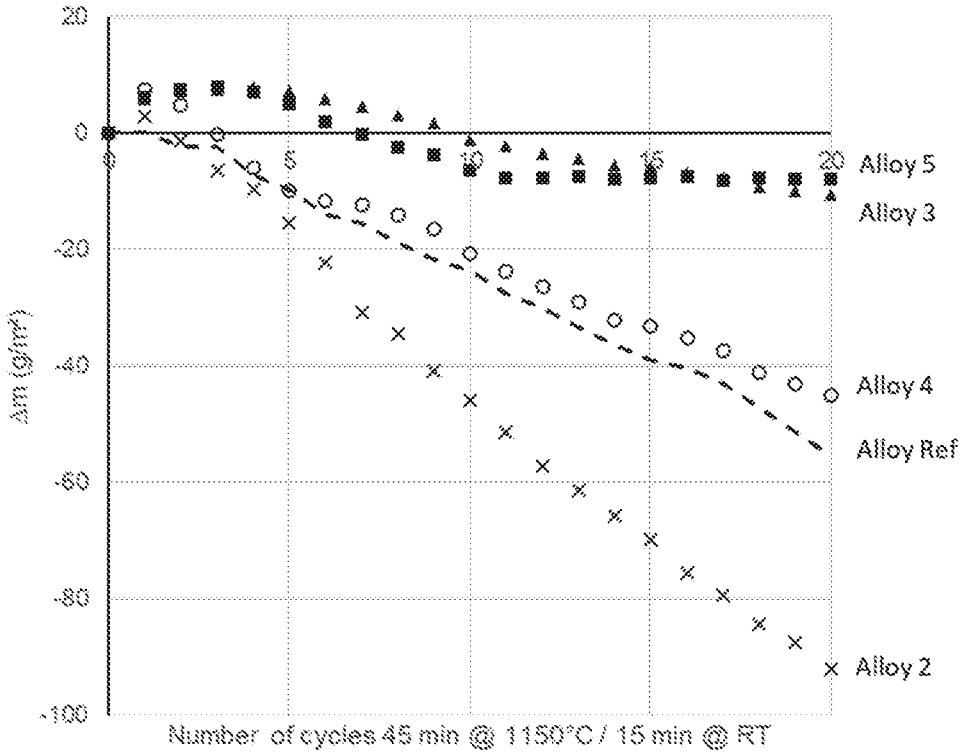
20
0
-20
-40
-60
-80
-100
Δm (g/m²)
0
5
10
15
20
Alloy 5
Alloy 3
Alloy 4
Alloy Ref
Alloy 2
Number of cycles 45 min @ 1150°C / 15 min @ RT

NICKEL-BASED REFRACTORY ALLOY WITH HIGH CHROMIUM CONTENT AND ASSOCIATED DESIGN METHOD

PRIORITY CLAIM

This application claims the benefit of the filing date of French Patent Application Ser. No. 19/07,175, filed Jun. 28, 2019.

TECHNICAL FIELD

The present invention relates to the field of austenitic alloys requiring good mechanical and environmental resistance at high temperatures, in particular for use in steam cracking furnaces in the petrochemical industry. It particularly relates to an austenitic alloy with a high chromium content, which has excellent resistance to corrosion and to creep at temperatures above 900° C.

BACKGROUND

Austenitic alloys based on nickel, chromium and iron, called "refractory" alloys, have been known for many years for their applications at very high temperatures (see in particular document FR 2333870). Their resistance to corrosion, carburation and coking is ensured by the development of a protective chromium oxide on their surface under the conditions of use. However, their lifespan is limited by their gradual depletion of chromium.

It is therefore desirable for the robustness of the protective chromium oxide on their surface to be increased, in order to delay and attenuate this gradual depletion of chromium from the alloy during operation.

Document EP 0765948 proposes an alloy with a high chromium content, having good resistance to corrosion at high temperatures. This alloy comprises the following elements, by mass percentage: 0.1% to 0.5% of Carbon, 0% to 4% of Silicon, 0% to 3% of Manganese, 40% to 50% of Chromium, 0% to 10% of Iron, 0.01% to 0.6% of Titanium, 0.01% to 0.2% of Zirconium, at least one of the Tungsten, Niobium and Molybdenum elements, respectively from 0.5% to 5%, from 0.3% to 2% and from 0.5% to 3%, and the balance in Nickel and impurities.

However, it has been observed that increasing the quantity of chromium, which considerably promotes corrosion resistance, is often accompanied by a reduction in the creep resistance.

It therefore remains important to further improve the properties of these alloys with a high chromium content, in order to achieve high performance capabilities, both in terms of resistance to the environment and to cyclic oxidation, as well as in terms of creep resistance and ductility after aging.

BRIEF SUMMARY

Embodiments of the present disclosure relate to an austenitic alloy with a high chromium content, which has excellent resistance to the environment and to creep and has high ductility after aging, at temperatures that are greater than or equal to 900° C. The invention also relates to a method for designing such an alloy.

The present disclosure relates to an austenitic alloy based on nickel and with a high chromium content, intended to be used at a given operating temperature between 900° C. and 1150° C. The alloy comprises the following elements by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earths or hafnium, between 0.002% and 0.1%;
silicon between 0% and 1%;
manganese between 0% and 0.5%;
nickel to balance the elements of the alloy.

The alloy also has a molar fraction of secondary carbo-nitrides rich in niobium and/or titanium of more than 0.1%, after the operating temperature has been applied thereto.

According to other advantageous and non-limiting features of the present disclosure, taken alone or in any technically feasible combination:

the secondary carbo-nitrides are of the MX type, with the metal M being niobium and/or titanium, at more than 80%, or even at more than 90%, with X being composed of carbon and nitrogen;

the mass percentages of chromium, iron, carbon, titanium, niobium, silicon and manganese are in accordance with the following relation (R2):

$$1.4022-1.2994\times10^{-4}\times x_{Si}^2+1.8791\times10^{-3}\times x_{Si}+5.5337\times10^{-7}\times x_{Cr}^4-8.8976\times10^{-5}\times x_{Cr}^3+5.3453\times10^{-3}\times x_{Cr}^2-1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1$$

The invention also relates to a method for designing an austenitic alloy based on nickel and with a high chromium content, intended to be used at a given operating temperature between 900° C. and 1150° C., the alloy comprising the following elements by mass percentage:

chromium between 40% and 45%;
iron between 10% and 14%,
carbon between 0.4% and 0.6%;
titanium between 0.05% and 0.2%;
niobium between 0.5% and 1.5%;
at least one reactive element, selected from rare earths or hafnium, between 0.002% and 0.1%;
silicon between 0% and 1%;
manganese between 0% and 0.5%;
nickel to balance the alloy elements.

The method comprises a step of selecting the mass percentages of chromium ($x_{Cr}$), iron ($x_{Fe}$), carbon ($x_C$), titanium ($x_{Ti}$), niobium ($x_{Nb}$), silicon ($x_{Si}$) and manganese ($x_{Mn}$), so that the alloy has a molar fraction ($f^{MX}$) of secondary carbo-nitrides rich in niobium and/or titanium of more than 0.1%, after the operating temperature has been applied thereto.

According to other advantageous and non-limiting features of the present disclosure, taken alone or in any technically feasible combination:

the molar fraction ($f^{MX}$) of secondary carbo-nitrides rich in niobium and/or titanium is measured by scanning or transmission electron microscopy, on a sample formed in the alloy after the operating temperature has been applied thereto;

the mass percentages of chromium ($x_{Cr}$), iron ($x_{Fe}$), carbon ($x_C$), titanium ($x_{Ti}$), niobium ($x_{Nb}$), silicon ($x_{Si}$) and manganese ($x_{Mn}$) are in accordance with the following relation (R2):

$$1.4022-1.2994\times10^{-4}\times x_{Si}^2+1.8791\times10^{-3}\times x_{Si}+5.5337\times10^{-7}\times x_{Cr}^4-8.8976\times10^{-5}\times x_{Cr}^3+5.3453\times10^{-3}\times x_{Cr}^2-1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1$$

Finally, the present disclosure relates to a method for validating an austenitic alloy based on nickel and with a high chromium content for its use at a given operating temperature between 900° C. and 1150° C., the alloy comprising the following elements by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earths or hafnium, between 0.002% and 0.1%;
silicon between 0% and 1%;
manganese between 0% and 0.5%;
nickel to balance the elements of the alloy.

The validation method comprises a step of verifying that the molar fraction ($f^{MX}$) of secondary carbo-nitrides rich in niobium and/or titanium in the alloy is greater than 0.1%, after the operating temperature has been applied to said alloy.

BRIEF DESCRIPTION OF THE DRAWINGS

Further features and advantages of the invention will become apparent from the following detailed description of the invention, with reference to the appended tables and FIGURES, in which:

FIG. 1 shows the loss of mass observed during the cyclic oxidation of certain tested alloys.

DETAILED DESCRIPTION

The present disclosure relates to an austenitic alloy based on nickel, chromium and iron intended to be used at an operating temperature between 900° C. and 1150° C.

It should be noted that the austenitic alloy according to the invention could be used at operating temperatures below 900° C., but would not offer, in these temperature ranges, any significant advantage compared to a standard alloy containing less than 40% chromium.

The alloy comprises the following compounds, with their quantity in the alloy being expressed by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earths and hafnium, between 0.002% and 0.1%;
silicon between 0% and 1%;
manganese between 0% and 0.5%;
nickel to balance the alloy elements.

Throughout the remainder of the description, the expressions "content," "quantity" or "percentage" in terms of a compound of the alloy should be interpreted as relating to the "mass percentage" of the element.

The alloy according to the disclosure is based on nickel and has a high chromium content in order to ensure good resistance to corrosion, to carburation and to coking, by virtue of the development of a protective chromium oxide on the surface of the alloy under the operating conditions.

The chromium content according to the present disclosure is also defined in a relatively limited range. A minimum of 40% chromium is required, as mentioned above, for good environmental resistance.

This high percentage of chromium induces a change in the nature of the alloy compared to reference refractory alloys that contain 25% chromium. In the reference alloys, primary carbides rich in M7C3 chromium are formed when the alloy solidifies. At high temperature, these carbides are unstable and transform into M23C6 carbides, which transformation is accompanied by a precipitation of secondary M23C6 carbides, which considerably improve the creep resistance of the alloy. Reference can be made to the article by M. Roussel et al, "Influence of solidification induced composition gradients on carbide precipitation in FeNiCr heat resistant steels," Materialia 4 (2018) 331-339. In an alloy containing more than 40% chromium, this phenomenon does not exist because the primary carbides formed when the alloy is cast are directly of the M23C6 type. It is therefore crucial for this phenomenon to be replaced with another mechanism that ensures the creep resistance of the alloy.

The maximum mass percentage of chromium is limited to 45% in order to limit the integration of the alphagene element tending to destabilize the austenitic structure of the alloy and to limit the formation of a Cr-rich α'-phase, one consequence of which is the loss of ductility after aging.

The iron content is also selected within a limited range. The minimum mass percentage of iron is defined at a value strictly greater than 10% so as to promote the formation of secondary MX-type carbo-nitrides rich in Nb and/or Ti at the operating temperature: M is therefore mainly niobium and/or titanium, and X is composed of carbon and nitrogen. Niobium, titanium and carbon are compounds included in the alloy and described hereafter. Nitrogen is introduced into the alloy during production, due to its presence in the raw materials and/or in the ambient atmosphere.

Secondary carbo-nitrides are understood to be the carbo-nitrides that precipitate during operation, as opposed to the primary carbides that are present in the structure of the alloy as cast.

The presence of these secondary carbo-nitrides provides the alloy with good creep resistance.

Advantageously, the minimum iron content is even 10.5%, or even 10.8%. In addition, the quantity of iron is less than or equal to 14% to limit the integration of an alphagene element tending to destabilize the austenitic structure of the alloy and the formation of a Cr-rich α'-phase. The quantity of iron advantageously can be less than or equal to 12%.

The mass percentage of carbon is defined at a minimum of 0.4% to allow the formation of a significant molar fraction of secondary MX-type carbo-nitrides in the alloy, the carbo-nitrides enhancing the creep resistance of the alloy. The maximum percentage is set to 0.6% in order to maintain sufficient ductility for the use of the material, the reinforcement by the carbo-nitrides also having the effect of reducing ductility.

Titanium has a significant impact on the formation of finer and uniformly distributed secondary carbo-nitrides in the alloy: it is particularly effective at low contents, called micro-additions. Titanium is included in the alloy as a mass percentage ranging from 0.05% to 0.2%.

Niobium, in proportions ranging from 0.5% to 1.5%, is added to the alloy. This compound is essential for the formation of secondary MX-type carbo-nitrides. The lower limit of the range is particularly important since it ensures the triggering of a precipitation of secondary MX-type carbon carbides during operation: in fact, the Applicant has observed that with a content of less than 0.5%, the precipitation was not triggered. The upper limit is basically dictated by economic reasons, with niobium being a relatively expensive compound.

The addition of at least one reactive element, selected from rare earth elements (such as, for example, yttrium, cerium, etc.) or hafnium, is beneficial to the growth and the adhesion of the oxide layer of chromium on the surface of the alloy. The total quantity of reactive elements is set to a minimum of 0.002%. A total quantity of more than 0.1% does not provide any additional effect, whereas it involves a significant impact on the cost; it can even be detrimental to the mechanical properties. Advantageously, the total content of reactive element(s) is limited to 0.05%.

The alloy optionally can contain silicon, to promote flow when the alloy is cast and to strengthen its resistance to corrosion. The quantity of silicon is nevertheless limited to 1% to avoid negatively impacting the creep resistance of the alloy and the adhesion of the chromium oxide layer. This limit also makes it possible to preserve good ductility after aging.

The alloy can also contain manganese, but as a mass percentage of less than 0.5% to avoid or limit the formation of spinel manganese oxide and chromium, which exhibits very fast formation kinetics, but is less stable and protective than chromium oxide.

Finally, the alloy comprises Ni, as a percentage complementing the composition of the alloy, so that the sum of the mass percentages of the compounds reaches 100%. The role of nickel in the alloy is to keep a refractory alloy with an austenitic structure. In the alloy according to the present disclosure, the quantity of nickel does not exceed 50%, in line with economic reasons, with nickel being a major cost contributor.

Of course, the alloy can also comprise, with a very low content, other conventional elements of steels that are particularly found in the raw materials or in the manufacturing steps. With a very low content, these elements have little impact or particular requirement. Contents of elements, such as molybdenum or copper, are thus found that are strictly below 0.5%. The alloy possibly may be polluted by trace impurities such as phosphorus, sulfur, lead, tin, zirconium, tungsten, etc., the content of which is of the order of a particle per million (ppm) and is strictly less than a hundred particles per million.

As mentioned in the introduction, it is normal for an austenitic alloy with a high chromium content (above 40%), correlatively with excellent corrosion resistance, to exhibit a degradation in creep resistance.

Thus, beyond the role of each individual compound of the alloy, the Applicant has studied the link between the microstructure of the alloy and its mechanical properties at the operating temperature or above. The operating temperature is the temperature that the alloy is intended to experience during its use: for example, for an alloy forming a steam cracking furnace tube, the operating temperature may be between 900° C. and 1150° C.

These studies, particularly based on characterizations by scanning or transmission electron microscopy and on creep tests, have been able to show the fact that the creep properties of the alloy with a high chromium content (more than or equal to 40%) are directly affected by the precipitation of secondary MX-type carbo-nitrides at the operating temperature, with M being mainly niobium or titanium, with "mainly" meaning "at more than 80%, or even 90%" in this case, and X being carbon and nitrogen.

Thus, the Applicant has been able to determine that, in an austenitic alloy with a high chromium content, the creep resistance, at the operating temperature, increases with the increase in the molar fraction of secondary MX-type carbo-nitrides that are rich in Nb and/or Ti in the alloy brought to the temperature.

On the basis of these observations, a feature of the austenitic alloy according to the present disclosure is that it has at least 0.1% (by molar percentage) of these secondary MX-type carbo-nitrides, after the operating temperature has been applied thereto for a few hours, typically for 10 hours or more. The fact that the austenitic alloy comprises a minimum molar fraction of secondary MX-type carbo-nitrides that are rich in Nb and/or Ti ensures that the austenitic alloy with a high chromium content has excellent creep resistance, in addition to excellent environmental resistance (corrosion) linked to the high percentage of chromium.

The presence of a minimum molar fraction of secondary MX-type carbo-nitrides in the alloy after the operating temperature has been applied thereto can be experimentally verified on a sample (for example, through analysis by scanning or transmission electron microscopy) or, alternatively, as proposed hereafter, can be anticipated during the design of the alloy or verified from the composition of the alloy measured by spark spectrometry.

From correlations between the physical characterizations and CALPHAD simulations (calculations of phase diagrams, making it possible to predict the phases present in the alloy at equilibrium temperature, depending on its composition), a relation R1 has been established between the mass percentages of certain compounds of the alloy and the molar fraction $f^{MX}$ of secondary MX-type carbo-nitrides, for a typical temperature for the operating temperature (in this case 1100° C.):

$$\begin{aligned} f^{MX} = {} & 1.4022 - 1.2994\times10^{-4}\times x_{Si}^2 + 1.8791\times10^{-3}\times x_{Si} + \\ & 5.5337\times10^{-7}\times x_{Cr}^4 - 8.8976\times10^{-5}\times x_{Cr}^3 + 5.3453\times \\ & 10^{-3}\times x_{Cr}^2 1.42\times10^{-1}\times x_{Cr} - 4.5781\times10^{-6}\times x_{Fe}^2 + \\ & 4.5556\times10^{-4}\times x_{Fe} + 1.5347\times x_{Ti}^4 - 1.1578\times x_{Ti}^3 + \\ & 2.6301\times10^{-1}\times x_{Ti}^2 + 1.3352\times10^{-2}\times x_{Ti} + 7.9375\times \\ & 10^{-4}\times x_{Nb}^4 - 2.06378\times10^{-3}\times x_{Nb}^3 + 1.9558\times10^{-3}\times \\ & x_{Nb}^2 + 6.6442\times10^{-3}\times x_{Nb} + 3.0959\times10^{-1}\times x_C^4 - \\ & 5.1282\times10^{-1}\times x_C^3 + 3.1538\times10^{-1}\times x_C^2 - 8.5003\times \\ & 10^{-2}\times x_C - 3.3333\times10^{-6}\times x_{Mn}^3 + 1.5\times10^{-5}\times x_{Mn}^2 + \\ & 2.2833\times10^{-4}\times x_{Mn} \end{aligned} \quad \text{R1}$$

Where $f^{MX}$ is the molar fraction of secondary MX-type carbo-nitrides, and $x_{Si}$, $x_{Cr}$, $x_{Fe}$, $x_{Ti}$, $x_{Nb}$, $x_C$, $x_{Mn}$ are the mass percentages of Si, Cr, Fe, Ti, Nb, C and Mn in the alloy, respectively.

Since the $f^{MX}$ molar fraction of MX carbo-nitrides varies only slightly between 900° C. and 1150° C. in the range of studied alloys, the evaluation of $f^{MX}$ for a single temperature (in this case 1100° C.) is sufficient to discriminate compositions offering good creep resistance from those offering low creep resistance.

The mass percentages $x_{Si}$, $x_{Cr}$, $x_{Fe}$, $x_{Ti}$, $x_{Nb}$, $x_C$, $x_{Mn}$, respectively of the Si, Cr, Fe, Ti, Nb, C and Mn in the alloy, thus can be selected so that the alloy has at least 0.1% (by molar percentage) of secondary MX-type carbo-nitrides, after the operating temperature Ts has been applied thereto for a few hours.

In particular, the aforementioned mass percentages can be selected so as to adhere to the following relation R2:

$$1.4022-1.2994\times10^{-4}\times x_{Si}^2+1.8791\times10^{-3}\times x_{Si}+5.5337\times10^{-7}\times x_{Cr}^4 8.8976\times10^{-5}\times x_{Cr}^3+5.3453\times10^{-3}\times x_{Cr}^2-1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1\% \quad (R2)$$

Compliance with the relation R2 ensures that the molar fraction of secondary MX-type carbo-nitrides will be formed at the operating temperature, thus guaranteeing good creep resistance of the alloy, in addition to its ductility qualities and corrosion resistance.

Table 1 below shows the composition of various alloys that have been studied by the Applicant, including an alloy according to the present disclosure.

TABLE 1

| Alloy n° | C | Si | Mn | Cr | Fe | Nb | Ti | Ni | Reactive Element(s) |
|---|---|---|---|---|---|---|---|---|---|
| 1 | 0.39 | 1.39 | 1.45 | 41.52 | 9.37 | 0.65 | 0.15 | Bal. 45.08 | |
| 2 | 0.47 | 2.15 | 1.33 | 40.28 | 5.66 | 0.73 | 0.04 | Bal. 49.34 | |
| 3 | 0.37 | 1.3 | 0.11 | 41.95 | 10.38 | 0.93 | 0.08 | Bal. 44.88 | 0.005 |
| 4 | 0.37 | 0.28 | 1.42 | 41.71 | 10.5 | 0.94 | 0.04 | Bal. 44.74 | |
| 5 | 0.42 | 0.64 | 0.17 | 41.14 | 10.81 | 0.93 | 0.08 | Bal. 45.81 | 0.005 |
| Ref | 0.45 | 1.3 | 1.3 | 35 | Bal. 16.17 | 0.7 | 0.08 | 45 | |

The alloy referenced "Ref" is a commercial alloy (Manaurite® X™) usually used for steam cracking furnaces in the petrochemical industry. Its chromium content (35%) limits its resistance to the environment and in particular its performance in terms of cyclic oxidation. However, it has very good creep and ductility properties. The alloy according to the present disclosure therefore aims to obtain an equivalent or even higher level in terms of creep resistance and ductility, and to improve the resistance to cyclic oxidation, compared with this reference alloy.

The alloys 1 to 4 are tested alloys that do not comply with the composition of the alloy according to the present disclosure and/or that do not comply with the molar fraction f of secondary MX-type carbo-nitrides targeted according to the present disclosure. The alloy 5 is an example of an alloy according to the present disclosure.

The examples of alloys 1 to 5 have a high chromium content (greater than 40%). Their high resistance to the environment (corrosion, carburation, coking) has been verified and provides the alloys with a higher level of performance compared to the reference alloy Ref.

The performance tests presented hereafter mainly relate to the resistance of the alloys to cyclic oxidation, their creep resistance and their ductile nature after aging.

FIG. 1 shows the loss of mass linked to the scaling of the chromium oxide layer during the cyclic oxidation of alloys 2, 3, 4 and 5 and compares them to the loss of mass observed during the cyclic oxidation of the reference alloy Ref. The graph shows the number of cycles on the abscissa, with a cycle corresponding to 45 min at 1150° C. and 15 min at ambient temperature. It can be seen that the high chromium content in a refractory alloy is not a sufficient condition with respect to its resistance to cyclic oxidation. In fact, the alloy 2, despite its high chromium content, exhibits more pronounced scaling during cyclic oxidation than the reference alloy Ref. This poor resistance to cyclic oxidation is explained by its relatively high silicon content, reducing the adhesion of the chromium oxide layer on the surface of the alloy and promoting its scaling.

The alloy 4 has substantially higher scaling resistance than the reference alloy Ref. The low silicon content of the alloy 4 contributes to this improvement.

Finally, the alloy 5, as well as the alloy 3, exhibit very good resistance to cyclic oxidation. The mass percentages of silicon and manganese in limited ranges contribute to this good performance. The presence of one or more reactive element(s) (also in a limited content range) further improves performance.

The creep resistance of the alloys presented in table 1 was evaluated from creep tests at 1100° C., subject to a stress of 12.87 MPa, with the tests being carried out on samples taken from parts produced in the various alloys.

Table 2 below shows the time-to-break $t_R$ obtained during creep tests carried out on the tested alloys and the molar fraction of secondary MX-type carbo-nitrides calculated for each of said alloys. A time-to-break $t_R$, expressed in hours, is extracted from these tests to arrive at the breaking point of the sample, as noted in Table 2 below.

TABLE 2

| Alloy | Stress 12.87 MPa Temperature 1100° C. $t_{R(h)}$ | $f_{MX(1100°\ C.)}$ % |
|---|---|---|
| 1 | 229 | 0.47 |
| | 100 | |
| 2 | 36 | 0 |
| 3 | 274 | 0.44 |
| 4 | 111 | 0.16 |
| 5 | 281 | 0.32 |
| Ref | 299 | 0.31 |

The values of molar fraction $f^{MX}$ of secondary MX-type carbo-nitrides, calculated from the mass percentages of the compounds of each alloy according to the aforementioned relation R1, are also listed in Table 2. For the Ref alloy, a time-to-break $t_R$ of 299 hours was obtained.

It can be noted that the alloys 1, 3, 4 and 5, having a molar fraction $f^{MX}$ greater than the criterion stipulated in the present disclosure of 0.1% (relation R2), exhibit better creep behavior than the alloy 2 (time-to-break $t_R$ of 36 hours), for which the molar fraction $f^{MX}$ is less than 0.1%. The alloy 4 nevertheless exhibits a lower creep resistance (time-to-break $t_R$ of 111 hours), which is explained by the fact that the value of $f^{MX}$ is low even if it is greater than 0.1.

In addition, the alloy 5 according to the present disclosure has a creep resistance (time-to-break $t_R$ of 281 hours) that is greater than that of the alloys 1 to 4 and is very close to the targeted creep resistance of the alloy Ref.

Table 3 below shows the time-to-break $t_R$ obtained for some of the tested alloys, during creep tests under different stresses and temperatures. These creep tests were carried out at 1100° C. or 950° C., for different applied stresses, which confirm that the alloy 5 exhibits good creep resistance generally equivalent to that targeted by the reference alloy Ref, and that the alloy 2 exhibits low creep resistance.

TABLE 3

| | Stress | | | |
|---|---|---|---|---|
| | 8.93 MPa | 12.87 MPa | 13.5 MPa | 27.42 MPa |
| | Temperature | | | |
| Alloy No. | 1100° C. | 1100° C. | 1100° C. | 950° C. |
| | $t_{R(h)}$ | | | |
| 2 | 166 | 36 | 22 | 205 |
| 5 | 731 | 281 | 266 | 1647 |
| Ref | 1801 | 299 | 232 | 991 |

Table 4 below shows the elongation before and after aging of certain tested alloys, measured using a tensile test at different temperatures. The ductility values, in the raw cast state and after aging at 900° C. and 1100° C. for different durations, of alloys 3, 4, 5 and Ref were determined by a tensile test and are listed in Table 4.

TABLE 4

| | Elongation (%) | | | |
|---|---|---|---|---|
| Aging | Alloy 3 | Alloy 4 | Alloy 5 | Alloy Ref. |
| As cast | 11.2 | 9.6 | 11.4 | 10.2 |
| 250 h at 900° C. | 1.6 | 4.8 | 5.2 | 3.8 |
| 500 h at 900° C. | 0.28 | 1.14 | 1.2 | 1.5 |
| 100 h at 1100° C. | 5.6 | 11.6 | 11.9 | 9.2 |
| 250 h at 1100° C. | 6 | 14.8 | 13.5 | 12 |

The significant loss of ductility after aging observed in the alloy 3 is linked to its excessively high silicon content. This silicon content results in, after annealing, an increase in the molar fraction of G-phase rich in silicon and niobium in the alloy. The alloy 4 exhibits good performance in terms of ductility after aging, but does not have the required performance level in terms of resistance to cyclic oxidation (no better than the Ref alloy) and to creep, as indicated above.

The alloy 5, in accordance with the present disclosure, retains a good level of ductility after aging, comparable to the targeted level obtained on the reference alloy.

In order to exhibit excellent environmental resistance (corrosion, carburation, coking), while demonstrating good properties in terms of cyclic oxidation, creep and ductility after aging, at an operating temperature between 900° C. and 1150° C., the austenitic alloy with a high chromium content according to the present disclosure therefore comprises the compounds Ni, Cr, Fe, C, Si, Ti, Nb, Mn and a reactive element(s), according to mass percentages within the stated ranges, and further comprises a molar fraction of secondary MX-type carbo-nitrides rich in Nb and/or Ti of more than 0.1%, after the operating temperature has been applied thereto.

The present disclosure also relates to a method for formulating an austenitic alloy with a high chromium content (therefore resistant to the environment) intended to be used at an operating temperature between 900° C. and 1150° C., and having excellent resistance to creep, to cyclic oxidation and a good level of ductility after aging.

The formulation method applies to an alloy that comprises the following compounds, with their formulation quantity in the alloy being expressed as a mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earths or hafnium, between 0.002% and 0.1%;
silicon between 0% and 1%;
manganese between 0% and 0.5%;
nickel to balance the alloy elements.

The formulation method comprises selecting mass percentages $x_{Si}$, $x_{Cr}$, $x_{Fe}$, $x_{Ti}$, $x_{Nb}$, $x_C$, $x_{Mn}$, respectively of the Si, Cr, Fe, Ti, Nb, C and Mn in the alloy, so that the alloy has at least 0.1% (by molar percentage) of secondary MX-type carbo-nitrides rich in Nb and/or Ti, after the operating temperature Ts has been applied thereto for a few hours.

In particular, the aforementioned mass percentages are selected so as to be in accordance with the relation (R2) below:

$$1.4022-1.2994\times10^{-4}\times x_{Si}^2+1.8791\times10^{-3}\times x_{Si}+5.5337\times10^{-7}x_{Cr}^4-8.8976\times10^{-5}\times x_{Cr}^3+5.3453\times10^{-3}\times x_{Cr}^2 1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1\% \quad (R2)$$

Compliance with the relation (R2) ensures that the molar fraction $f^{MX}$ of secondary MX-type carbo-nitrides will be formed at the operating temperature, thus guaranteeing good creep resistance for the alloy, in addition to its ductility and corrosion resistance qualities.

The present disclosure further relates to a method for validating the compatibility of an austenitic alloy with a high chromium content, with an operating temperature Ts between 900° C. and 1150° C. Compatible alloy is understood to be an alloy having excellent resistance both to corrosion, to cyclic oxidation and to creep, while retaining a good level of ductility.

The validation method comprises a step of verifying that the molar fraction of secondary carbo-nitrides rich in niobium and/or titanium in the alloy is greater than 0.1%, after the operating temperature has been applied to the alloy.

This molar fraction can be measured on samples made up of the alloy to be verified, for example, through analysis by scanning or transmission electron microscopy; or alternatively, the molar fraction $f^{MX}$ can be verified by virtue of the relation R2, from the composition of the alloy measured by spark spectrometry. If the inequality is adhered to for the relation R2, the alloy is compatible with the operating temperature range from 900° C. to 1150° C. If the inequality is not adhered to, the alloy is identified as being not compatible with this operating temperature range.

The austenitic alloys according to the present disclosure can be applied in the field of petrochemicals (steam cracking furnaces) or in any other high temperature application, typically greater than or equal to 900° C., combining problems of environmental resistance and creep.

Of course, the present disclosure is not limited to the embodiments and examples described, and it is possible to add alternative embodiments thereto without departing from the scope of the invention as defined by the claims.

What is claimed is:

1. An austenitic alloy based on nickel and having a high chromium content, the alloy comprising the following elements by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earth elements or hafnium, between 0.002% and 0.1%;
silicon between 0% and 1%;
manganese between 0% and 0.5%;
molybdenum and/or copper between 0% and 0.5%,
an impurity element between 0% and 0.01%; and
nickel to balance the alloy elements;
the alloy having a molar fraction of secondary carbo-nitrides rich in niobium and/or titanium of more than 0.1%, after subjecting the alloy to an operating temperature between 900° C. and 1150° C.

2. The austenitic alloy of claim 1, wherein the secondary carbo-nitrides are of a composition MX, with a metal M being niobium and/or titanium, at more than 80%, and with an element X being composed of carbon and nitrogen.

3. The austenitic alloy of claim 2, wherein the secondary carbo-nitrides comprise the metal M at more than 90%.

4. The austenitic alloy of claim 3, wherein the mass percentages of chromium, iron, carbon, titanium, niobium, silicon and manganese are in accordance with the following relation (R2):

$$1.4022-1.2994\times10^{-4}\times x_{Si}^2+1.8791\times10^{-3}\times x_{Si}+5.5337\times10^{-7}\times x_{Cr}^4-8.8976\times10^{-5}\times x_{Cr}^3+5.3453\times10^{-3}\times x_{Cr}^2-1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1.$$

5. A method for formulating an austenitic alloy based on nickel and having a high chromium content, comprising: formulating the alloy to comprise the following elements by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earth elements or hafnium, between 0.002% and 0.1%;
silicon between 0% and 1%;
manganese between 0% and 0.5%;
molybdenum and/or copper between 0% and 0.5%;
an impurity element between 0% and 0.01%; and
nickel to balance the alloy elements; and
selecting the mass percentages of chromium ($x_{Cr}$), iron ($x_{Fe}$), carbon ($x_C$), titanium ($x_{Ti}$), niobium ($x_{Nb}$), silicon ($x_{Si}$) and manganese ($x_{Mn}$) so that the alloy has a molar fraction ($f^{MX}$) of secondary carbo-nitrides rich in niobium and/or titanium of more than 0.1%, after subjecting the alloy to an operating temperature between 900° C. and 1150° C.

6. The method of claim 5, wherein the molar fraction ($f^{MX}$) of secondary carbo-nitrides rich in niobium and/or titanium is measured by scanning or transmission electron microscopy, on a sample formed of the alloy after the operating temperature has been applied thereto.

7. The method of claim 5, wherein the mass percentages of chromium ($x_{Cr}$), iron ($x_{Fe}$), carbon ($x_C$), titanium ($x_{Ti}$), niobium ($x_{Nb}$), silicon ($x_{Si}$) and manganese ($x_{Mn}$) are in accordance with the following relation (R2):

$$1.4022-1.2994\times10^{-4}\times x_{Si}^2+1.8791\times10^{-3}\times x_{Si}+5.5337\times10^{-7}\times x_{Cr}^4-8.8976\times10^{-5}\times x_{Cr}^3+5.3453\times10^{-3}\times x_{Cr}^2-1.42\times10^{-1}\times x_{Cr}-4.5781\times10^{-6}\times x_{Fe}^2+4.5556\times10^{-4}\times x_{Fe}+1.5347\times x_{Ti}^4-1.1578\times x_{Ti}^3+2.6301\times10^{-1}\times x_{Ti}^2+1.3352\times10^{-2}\times x_{Ti}+7.9375\times10^{-4}\times x_{Nb}^4-2.06378\times10^{-3}\times x_{Nb}^3+1.9558\times10^{-3}\times x_{Nb}^2+6.6442\times10^{-3}\times x_{Nb}+3.0959\times10^{-1}\times x_C^4-5.1282\times10^{-1}\times x_C^3+3.1538\times10^{-1}\times x_C^2-8.5003\times10^{-2}\times x_C-3.3333\times10^{-6}\times x_{Mn}^3+1.5\times10^{-5}\times x_{Mn}^2+2.2833\times10^{-4}\times x_{Mn}\geq0.1.$$

8. A method for validating an austenitic alloy based on nickel and having a high chromium content for its use at a given operating temperature between 900° C. and 1150° C., the alloy comprising the following elements by mass percentage:

chromium between 40% and 45%;
iron between 10% and 14%;
carbon between 0.4% and 0.6%;
titanium between 0.05% and 0.2%;
niobium between 0.5% and 1.5%;
at least one reactive element, selected from rare earths or hafnium, between 0.002% and 0.1%;
silicon between 0% and 1%;
manganese between 0% and 0.5%;
molybdenum and/or copper between 0% and 0.5%;
an impurity element between 0% and 0.01%; and
nickel to balance the alloy elements;
the method comprising:
measuring and recording the molar fraction ($f^{MX}$) of secondary carbo-nitrides rich in niobium and/or titanium in the alloy, after the operating temperature has been applied to the alloy; and
validating the austenitic alloy for its use at the given operating temperature when the molar fraction is greater than 0.1%.

* * * * *